US011305858B2

(12) United States Patent
Brackett et al.

(10) Patent No.: US 11,305,858 B2
(45) Date of Patent: Apr. 19, 2022

(54) MODULAR RUDDER SYSTEM

(71) Applicant: Hobie Cat IP, LLC, Oceanside, CA (US)

(72) Inventors: Drew William Brackett, Solana Beach, CA (US); William John Broadway, Encinitas, CA (US); James Taylor Czarnowski, Fallbrook, CA (US); Mark Joseph Johnson, Dana Point, CA (US); Jason Christopher Kardas, Oceanside, CA (US); Victor Daniel Ortiz, San Marcos, CA (US); Elizabeth Catherine Sexton, San Clemente, CA (US); Shane Yellin, Carlsbad, CA (US); Philip James Dow, Oceanside, CA (US)

(73) Assignee: Hobie Cat IP, LLC, Oceanside, CA (US)

( * ) Notice: Subject to any disclaimer, the term of this patent is extended or adjusted under 35 U.S.C. 154(b) by 0 days.

(21) Appl. No.: 17/477,932

(22) Filed: Sep. 17, 2021

(65) Prior Publication Data

US 2022/0063789 A1 Mar. 3, 2022

Related U.S. Application Data

(63) Continuation of application No. 16/948,128, filed on Sep. 3, 2020.

(51) Int. Cl.
*B63H 25/38* (2006.01)

(52) U.S. Cl.
CPC ..... *B63H 25/38* (2013.01)

(58) Field of Classification Search
CPC ..... B63H 25/00; B63H 25/38; B63B 35/79; B63B 35/7926; B63B 35/00
(Continued)

(56) References Cited

U.S. PATENT DOCUMENTS 4,556,006 A 12/1985 Kaupat
4,941,423 A 7/1990 Van Tassel
(Continued)

FOREIGN PATENT DOCUMENTS

CA 3035190 8/2020
CN 211001732 7/2020
(Continued)

OTHER PUBLICATIONS

[No Author Listed], "Parts & Accessories." Hobie Dealer Copy, Hobie Cat Company, Spring /Summer 2010, 52 pages.
(Continued)

*Primary Examiner* — Lars A Olson
(74) *Attorney, Agent, or Firm* — Fish & Richardson P.C.

(57) ABSTRACT

A stand-alone modular removable rudder system for watercraft having a rudder comprising a steering handle coupled to a quick release mechanism adapted to releasably secure said steering handle to said watercraft in proximity to the operator, said system further comprising, a rudder mount adapted to be coupled to the rear of the watercraft by a quick release mechanism adapted to releasably secure said rudder mount to said watercraft, said rudder being carried by a rudder support pivotal about said rudder mount and cables operatively connecting said steering handle to said rudder mount whereby the steering handle can be operated to steer the rudder.

62 Claims, 23 Drawing Sheets

(58) Field of Classification Search
USPC ..... 114/150, 162
See application file for complete search history.

(56) References Cited

U.S. PATENT DOCUMENTS

| | | | |
|---|---|---|---|
| 5,349,918 | A | 9/1994 | Elie |
| 5,386,368 | A | 1/1995 | Knight |
| 5,465,633 | A | 11/1995 | Bernloehr |
| 5,669,794 | A | 9/1997 | Knight et al. |
| D399,478 | S | 10/1998 | Strandell |
| 5,884,213 | A | 3/1999 | Carlson |
| 5,957,078 | A | 9/1999 | Van Tassel |
| 6,022,249 | A | 2/2000 | Ketterman |
| 6,213,821 | B1 | 4/2001 | Bernloehr et al. |
| 6,254,441 | B1 | 7/2001 | Knight et al. |
| 6,369,542 | B1 | 4/2002 | Knight |
| 6,394,859 | B1 | 5/2002 | Knight et al. |
| 6,431,923 | B1 | 8/2002 | Knight et al. |
| 6,612,252 | B2 | 9/2003 | King et al. |
| 6,990,920 | B2 | 1/2006 | Hamilton et al. |
| 7,086,914 | B1 | 8/2006 | Beamer et al. |
| 7,195,526 | B2 | 3/2007 | Bernloehr et al. |
| 7,320,291 | B2 | 1/2008 | Eckert |
| 7,381,108 | B1 | 6/2008 | Salmon |
| 7,430,976 | B2 | 10/2008 | Ketterman et al. |
| 7,497,748 | B2 | 3/2009 | Salmon |
| 7,637,791 | B2 | 12/2009 | Kettterman et al. |
| 7,681,513 | B1 | 3/2010 | Hundertmark |
| 7,722,417 | B2 | 5/2010 | Bernloehr et al. |
| 7,972,188 | B2 | 7/2011 | Bernloehr et al. |
| 8,082,871 | B2 | 12/2011 | Czamowski et al. |
| 8,753,156 | B2 | 6/2014 | Ketterman et al. |
| 8,869,731 | B2 | 10/2014 | Dow et al. |
| 9,296,455 | B2 | 3/2016 | Bernloehr et al. |
| 9,475,559 | B2 | 10/2016 | Czamowski et al. |
| 9,540,086 | B2 | 1/2017 | Ketterman et al. |
| 9,604,703 | B2 | 3/2017 | Kardas et al. |
| 9,623,944 | B2 | 4/2017 | Kuehmichel et al. |
| 9,676,462 | B2 | 6/2017 | Bernloehr et al. |
| 9,701,367 | B2 | 7/2017 | McDonough et al. |
| 9,731,802 | B2 | 8/2017 | Ketterman et al. |
| 9,981,726 | B2 | 5/2018 | Ketterman et al. |
| 10,005,531 | B1 | 6/2018 | Broadway et al. |
| 10,011,329 | B1 | 7/2018 | Cooper |
| 10,035,575 | B2 | 7/2018 | Bernloehr et al. |
| 10,046,837 | B2 | 8/2018 | Green et al. |
| 10,196,120 | B2 | 2/2019 | Turek |
| 10,259,553 | B2 | 4/2019 | Dow et al. |
| 10,407,140 | B2 | 9/2019 | Young |
| 10,479,449 | B2 | 11/2019 | Cooper |
| 10,758,049 | B2 | 9/2020 | Cooper |
| 11,124,275 | B2 | 9/2021 | Robbins et al. |
| 11,148,775 | B2 | 10/2021 | Kuehmichel |
| 2002/0069809 | A1 | 6/2002 | King et al. |
| 2008/0060569 | A1* | 3/2008 | Howard ..... B63H 25/38 114/347 |
| 2013/0220208 | A1 | 8/2013 | Boyer |
| 2018/0215447 | A1 | 8/2018 | Cooper |
| 2020/0247516 | A1 | 8/2020 | Lammers-Meis et al. |
| 2021/0001955 | A1 | 1/2021 | Cooper |
| 2021/0047021 | A1 | 2/2021 | Boyer et al. |
| 2021/0070411 | A1 | 3/2021 | Bragg |
| 2021/0221477 | A1 | 7/2021 | Steed et al. |
| 2021/0284309 | A1 | 9/2021 | Kuehmichel et al. |
| 2021/0371057 | A1 | 12/2021 | Boyer et al. |

FOREIGN PATENT DOCUMENTS

| | | |
|---|---|---|
| WO | WO 2008/016681 | 2/2008 |
| WO | WO 2009/017626 | 2/2009 |
| WO | WO 2010/017474 | 2/2010 |
| WO | WO 2017/019140 | 2/2017 |
| WO | WO 2018/009206 | 1/2018 |
| WO | WO 2018/126817 | 7/2018 |

OTHER PUBLICATIONS

Author Unknown, "Kayak Rudder", https://www.instmctables.com/id/Kayak-rudder/, Outside Projects section, posted by yakhack in Outside>Boats, 2015.

Media.hobie.com [online], "Hobie Mirage Pro Angler Owner's Manual", Apr. 13, 2009, retrieved on Sep. 15, 2021, retrieved from URL <https://media.hobie.com/digital_assets/pro_angler_manual.pdf>, 16 pages.

[No Author Listed], "Hobi ills Inflatable SUP/Kayak Setup for Fishing," Jan. 17, 2018, retrieved on Jan. 28, 2022, retrieved from URL <"https://www.youtube.com/watch?v-fh6owE5D2Y4&t-902s">, 3235 pages [Video Submission].

[No Author Listed], "Pelican Catch 130 HyDryve Fishing Kayak Specs & Features Review and Walk-Around," Jul. 11, 2018, retrieved on Jan. 28, 2022, retrieved from URL <"https://www.youtube.com/watch?v=ZWGRX2FRtyo">, 396 pages [Video Submission].

[No Author Listed], "Pelican The Catch 110HDII & The Catch 130HDII Fishing Pedal Drive Kayaks," Feb. 11, 2020, retrieved on Jan. 28, 2022, retrieved from URL <"https://www.youtube.com/watch?v=L3U3r8eKzCQ">, 742 pages [Video Submission].

[No Author Listed], "Review of The Catch 130HD," Sep. 20, 2019, retrieved on Jan. 28, 2022, retrieved from URL <"https://www.youtube.com/watch?v=eDKcE6XZQis">, 3020 pages [Video Submission].

media.hobie.com [online], "Hobie Mirage Inflatable Kayak Manual," 2015, retrieved on Jan. 28, 2022, retrieved from URL <"https://media.hobie.com/digital_assets/Inflatable_Kayak_Manual.pdf">, 32 pages.

International Search Report and Written Opinion in International Application No. PCT/US2021/048475, dated Dec. 20, 2021, 18 pages.

* cited by examiner

MODULAR RUDDER SYSTEM

CROSS-REFERENCE TO RELATED APPLICATIONS

This application is a continuation application of and claims priority to U.S. application Ser. No. 16/948,128, filed Sep. 3, 2020.

BACKGROUND OF INVENTION

Watercraft such as kayaks, pedal boards and the like are normally steered by a rudder centrally positioned at the rear of the watercraft and pivot about a vertical axis. The rudder is steered using a steering handle which is either part of the rudder mechanism itself or is connected by cables to the rudder with the steering handle being located adjacent the operator of the watercraft who is normally positioned midway on the watercraft in a seated or standing position. Propulsion is provided by pedaling as disclosed, for example, in Ketterman, U.S. Pat. No. 6,022,249 and Czarnowski, et. al. U.S. Pat. No. 9,475,559, the disclosures of which are expressly incorporated herein by reference.

The rudder can also rotate about an axis transverse to the longitudinal dimension of the watercraft to be raised out of and lowered into the water, as described in the "Kayak Rudder" discussion posted to the Instructables.com do-it-yourself membership website's Outside projects section by an unidentified member in 2015. A hyperlink to this article can be found in the Information Disclosure Statement filed herewith.

In the prior art, the steering handle and the rudder are typically mechanically joined or built into the watercraft and require tools and extensive manual manipulation for their removal.

We have developed a stand-alone modular system whereby both the steering mechanism and the rudder mechanism can be easily slipped off, and on the watercraft, which after system removal, allows for the simplified carrying and storage of the watercraft.

The system can also be transferred from one watercraft to another.

BRIEF SUMMARY OF THE INVENTION

A stand-alone modular removable rudder system for watercraft having a rudder comprising a steering handle coupled to a quick release mechanism adapted to releasably secure said steering handle to said watercraft in proximity to the operator, said system further comprising, a rudder mount adapted to be coupled to the rear of the watercraft by a quick release mechanism adapted to releasably secure said rudder mount to said watercraft, said rudder being carried by a rudder support pivotal about said rudder mount and cables operatively connecting said steering handle to said rudder mount whereby the steering handle can be operated to steer the rudder.

A stand-alone modular removable rudder system for watercraft having a rudder comprising a steering handle coupled to a quick release mechanism adapted to releasably secure said steering handle to the watercraft in proximity to the operator, said system further comprising a rudder mount adapted to be coupled to the rear of the watercraft by a quick release mechanism adapted to releasably secure said rudder mount to said watercraft, said rudder being carried by a support pivotal about said rudder mount, and cables operatively connecting said steering handle to said rudder mount to pivot said rudder to steer, said rudder being rotatable on said rudder support about a transverse axis and a pull cord connected to said rudder support whereby the rudder can be rotated about said transverse axis and stowed on the deck of the watercraft.

BRIEF DESCRIPTION OF THE DRAWINGS

Turning to the drawings.

DETAILED DESCRIPTION OF THE PREFERRED EMBODIMENTS

One of the main advantages of the system is that it is a stand-alone, modular system which is capable of being quickly installed and removed from a variety of watercraft. This "quick-removal" feature is particularly important for inflatable craft that need to be deflated and folded up tightly as well as other watercraft where they are transported on the roof of a car and a rudder system makes this more difficult or dangerous. The rudder is raised and lowered using a single line that imparts a pivoting motion on the rudder blade and the weight of the blade carries it through to either a stowed or lowered position. The bungee keeps the rudder in either position. The overall rudder system of the invention comprises the quick release mechanisms for attaching the rudder and steering handle to the watercraft, the driving mechanism for the rudder which uses rotating quadrants, compression tubes and tensile cables and the integrated up/down feature using a single pull line.

Figure 1:
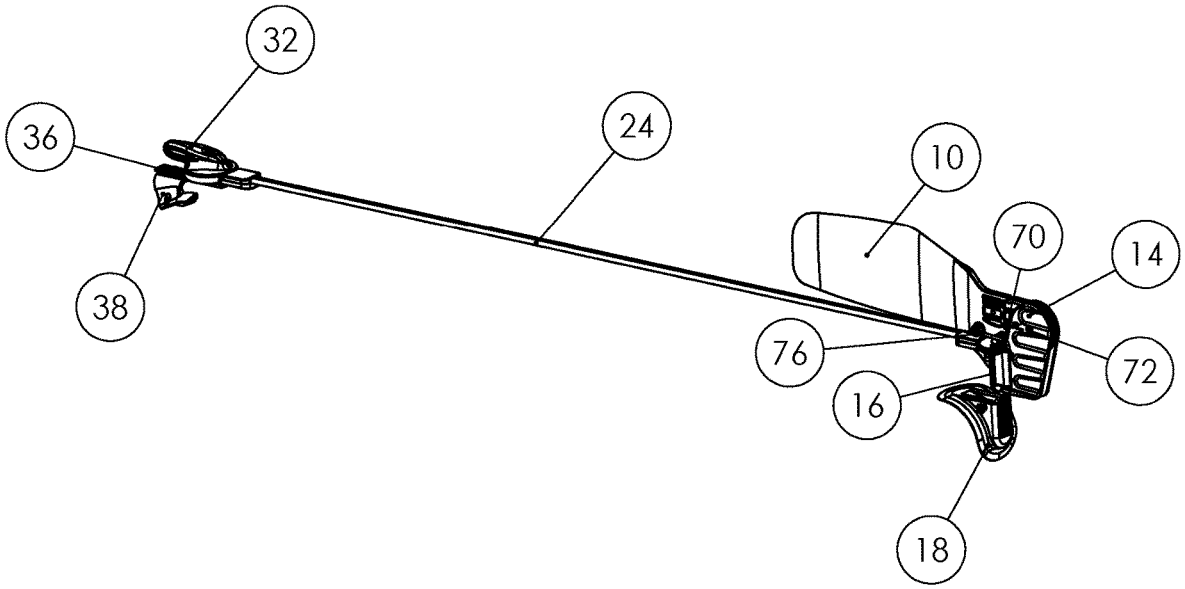
FIG. 1 is a perspective view of one preferred embodiment of the system of this invention showing a pedaled sit on kayak with the rudder prior to deployment and in the stowed position.
Figure 2:
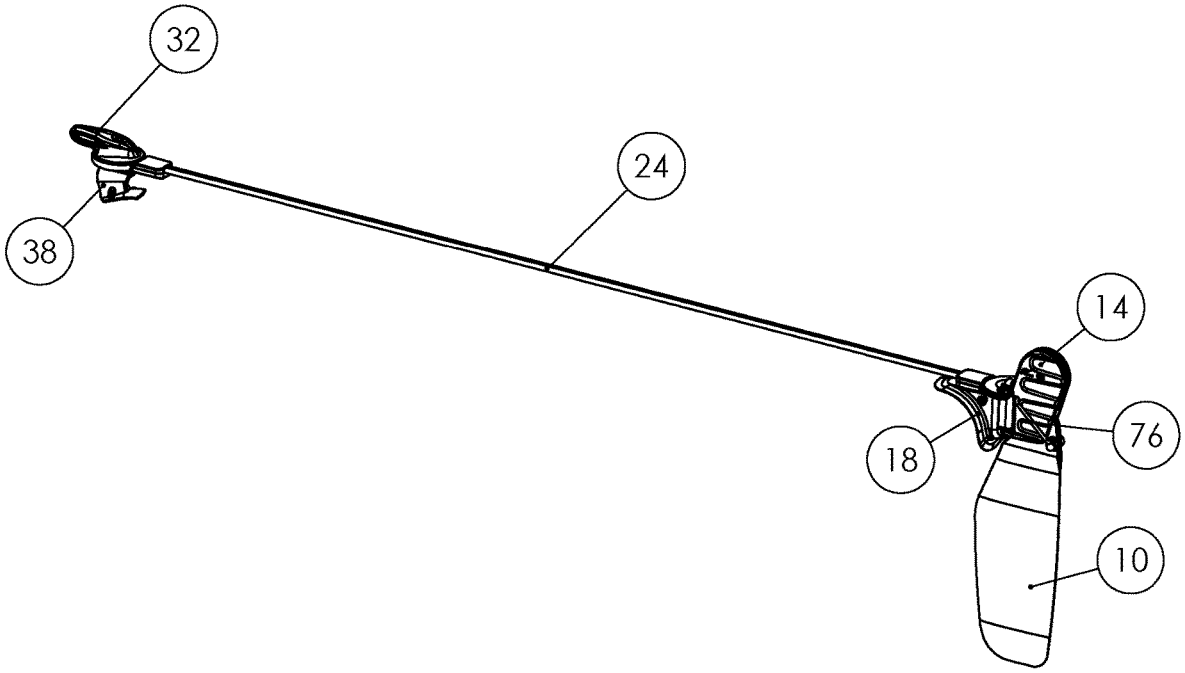
FIG. 2 is a perspective view of the embodiment of FIG. 1 with the rudder attached rotated in the deployed position.
Figure 3:
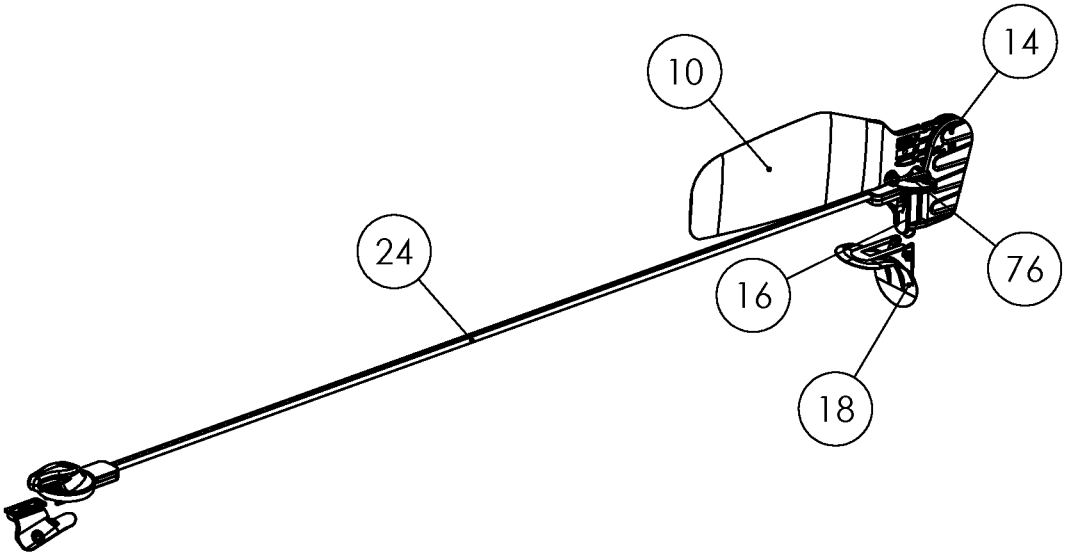
FIG. 3 is a perspective view of another embodiment of the system of this invention for a stand up pedaled board with the rudder prior to deployment and in the stowed position.
Figure 4:
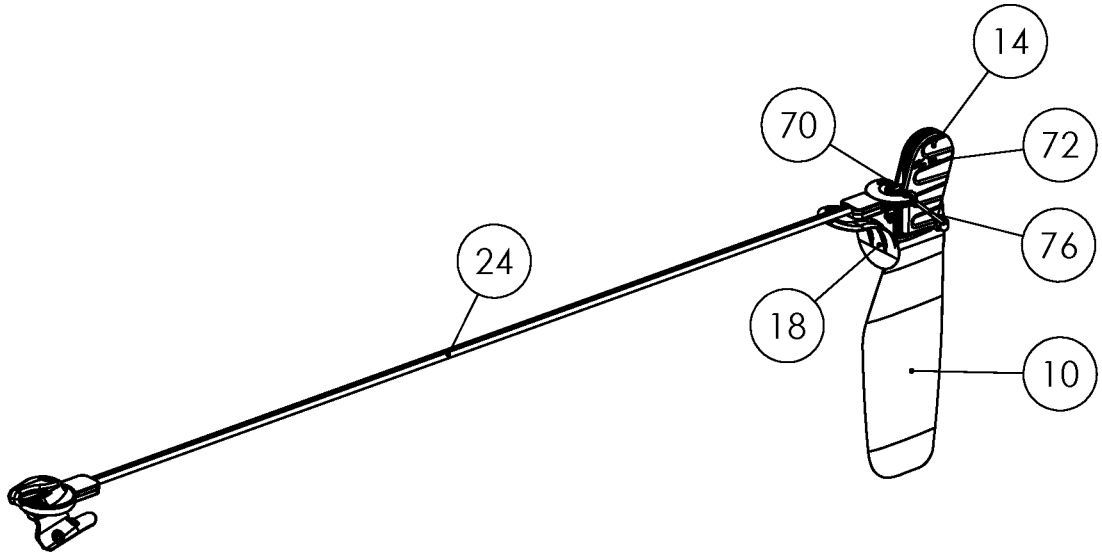
FIG. 4 is a perspective view of the embodiment of FIG. 3 with the rudder attached and rotated into the deployed position.
Figure 5:
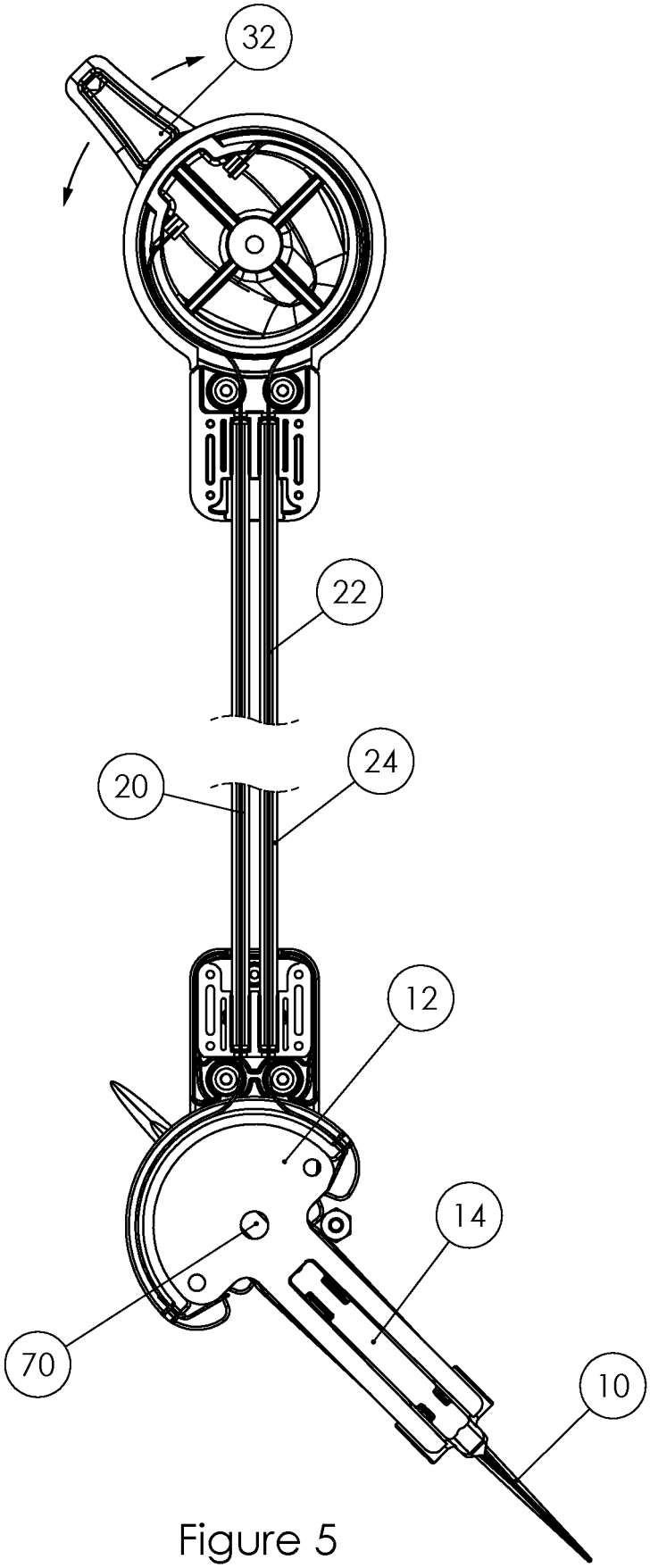
FIG. 5 is a top sectional away view of the system showing the connection of the cables to the steering handle and to the elements which pivot the rudder to steer, all common to both embodiments.
Figure 6:
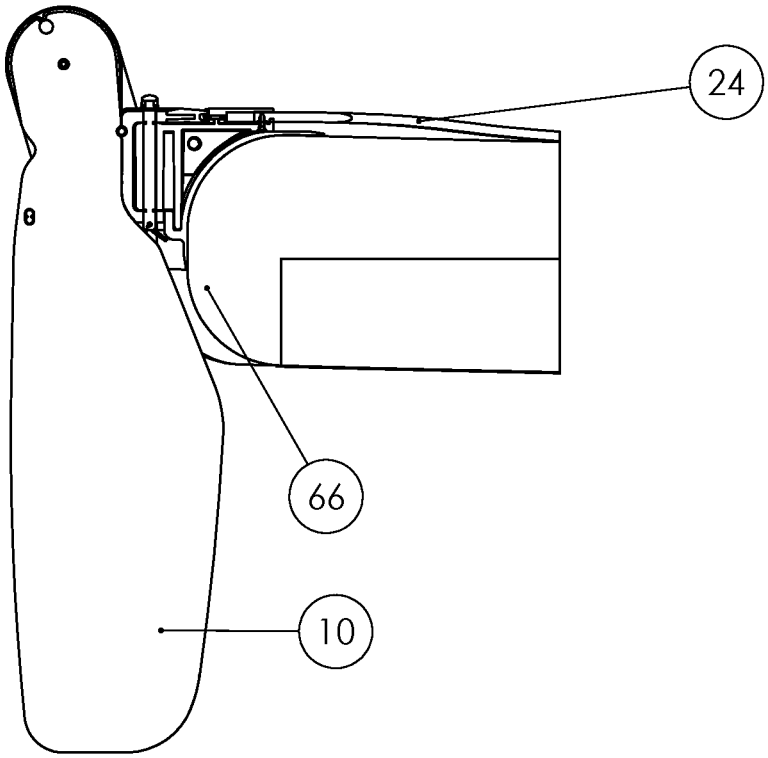
FIG. 6 is a partial side view with the rudder deployed and further showing the pull rope connection to the rudder support for rotating the rudder up and on to the deck from the deployed position.
Figure 6A:
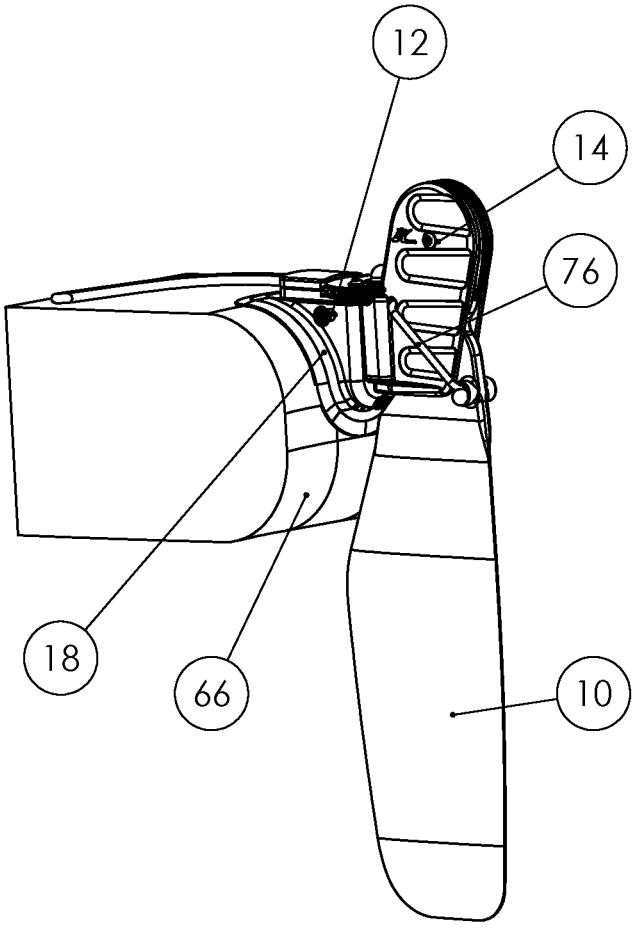
FIG. 6A is a partial perspective view showing the rear of the watercraft with the rudder in the deployed position, the pull rope for raising and lowering the rudder and bungee cords which serve to limit the relatively free rotational movement of the rudder about the rudder mount while allowing the deployed rudder to rotate sufficiently upon striking an obstacle in the water to avoid damage.

The stand alone modular removable rudder system comprises a rudder 10, rudder mount 12, rudder support 14, a projection 16 on the rudder mount and rudder retainer 18 which provides a quick releasable connection of the rudder mount 12 and rudder 10 to the watercraft. These elements are operated by tensile cables 20 and 22 generally shown in FIG. 5. The tensile cables are normally contained in a compression tube 24.

Figure 7:
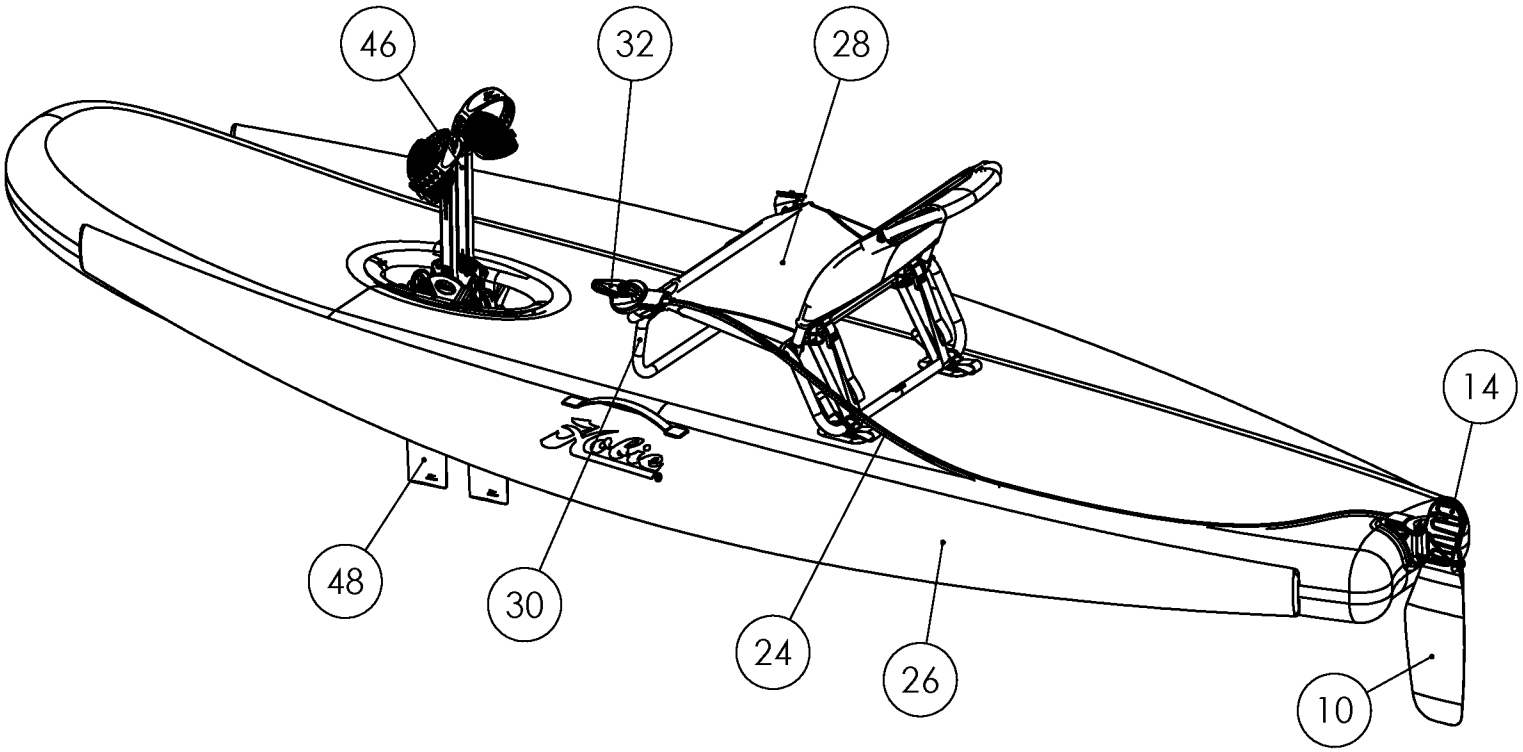
FIG. 7 is a perspective view of the system embodiment of FIGS. 1 and 2 installed on a pedaled sit on kayak watercraft.

The embodiment of the removable rudder systems of FIGS. 1, 2, 7 and 12A through 12E related to a pedaled sit on kayak 26 having a chair 28, shown in FIG. 7, for the operator. The chair normally has a tubular frame 30. The steering handle 32 is rotatably mounted in steering handle housing 34.

The steering handle housing retainer 38 is affixed to the tubular frame 30 of the chair by a bolt inserted through hole 40. The underside of the housing 34 has a slot for releasably receiving member 36 formed on retainer 38.

The retainer 38 has a hole 42 which receives a spring loaded quick release pin 44 which enters a hole in the housing 34. By pulling pin 44, the retainer 38 is easily separated from housing 34.

The embodiment of FIGS. 1, 2, 7 and 12A through 12E is propelled by the operator operating pedals 46 which move the flaps 48 in an arcuate path across the longitudinal dimension of the kayak 26.

Turing to the stand-up pedal board 50 embodiment shown in FIGS. 3, 4, 8 and 11, the rotatable steering handle 32 is rotatable in housing 52. There is a hollow tubular retainer 54 integral with the housing 52, one end of which provides a hand grip 56 for the operator, the opposite end 58 is adapted to snugly receive one free end of the handle bar 60 carried by upright 62, FIG. 11.

Figure 8:
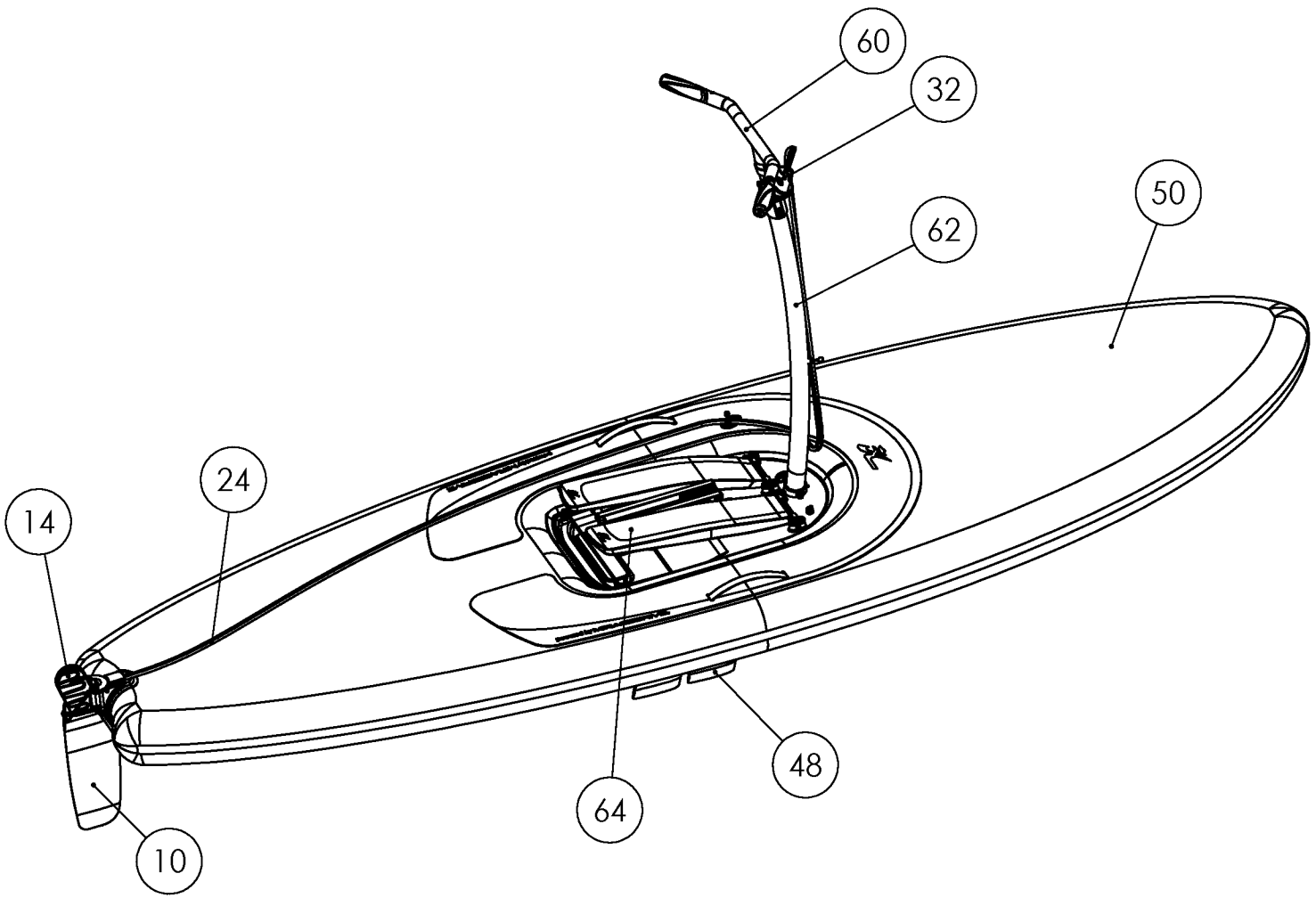
FIG. 8 is a perspective view of the system embodiment of FIGS. 3 and 4 installed on a stand up pedaled watercraft.
Figure 9:
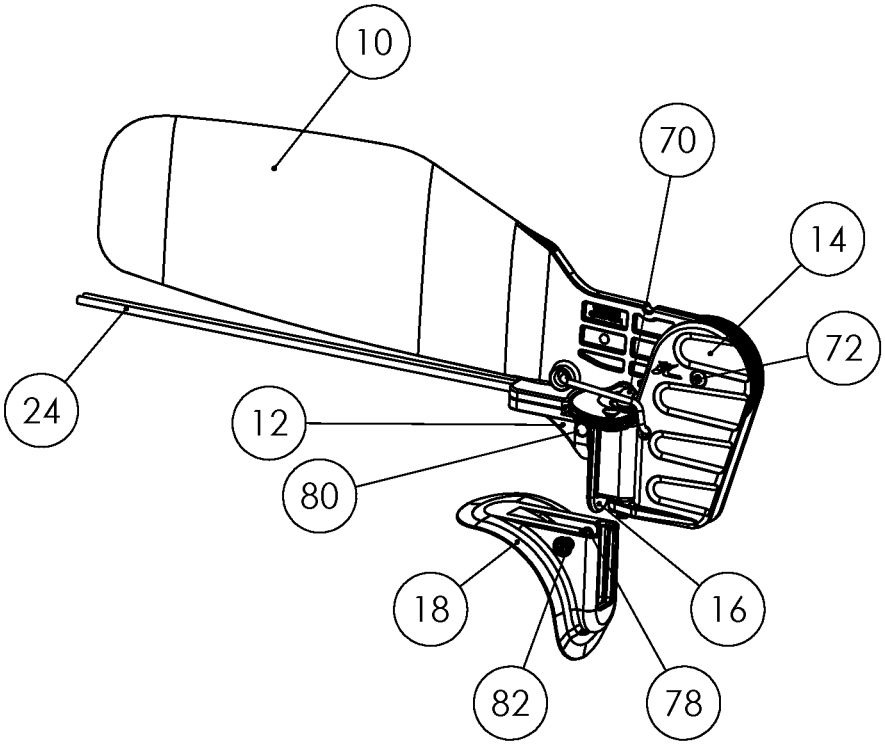
FIG. 9 is a partial side perspective view of the watercraft and rudder showing the retainer which is for attachment to the rear of the watercraft and the projection on the rudder mount in position to be releasably connected to the retainer and secured by a quick release pin.
Figure 10A:
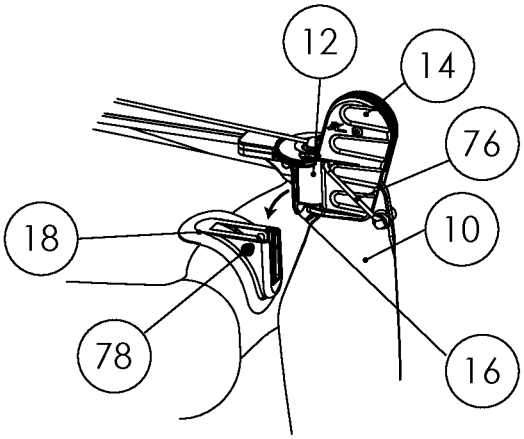
FIG. 10A shows the view of FIG. 9 showing the direction of movement as the retainer and rudder mount are slipped together.
Figure 10B:
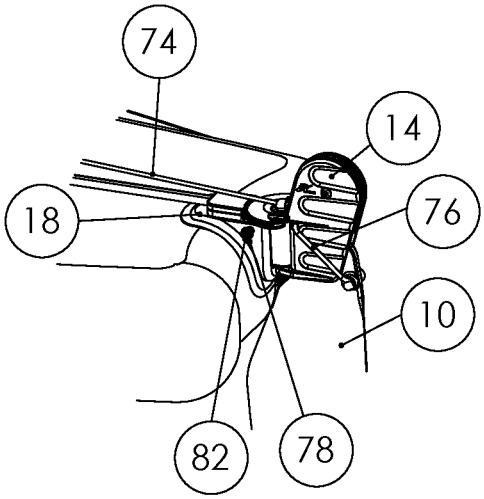
FIG. 10B shows the elements of FIGS. 9 and 10A slidably releasably connected.
Figure 10C:
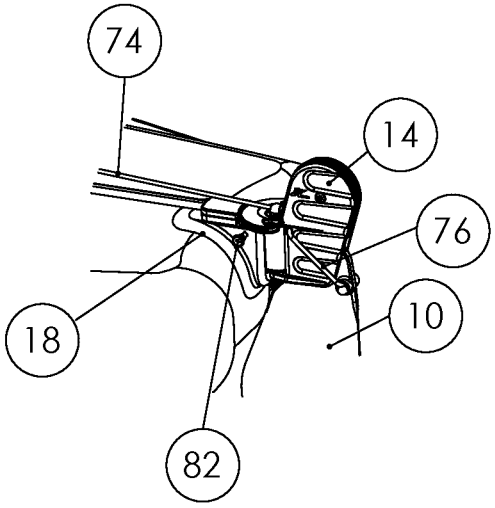
FIG. 10C shows the elements of FIGS. 10A and 10B with the spring loaded quick release pin in place.
Figure 10D:
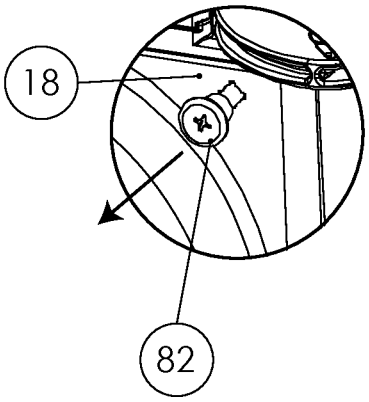
FIG. 10D is a detailed view of the spring loaded quick release pin shown in FIG. 10C.
Figure 11:
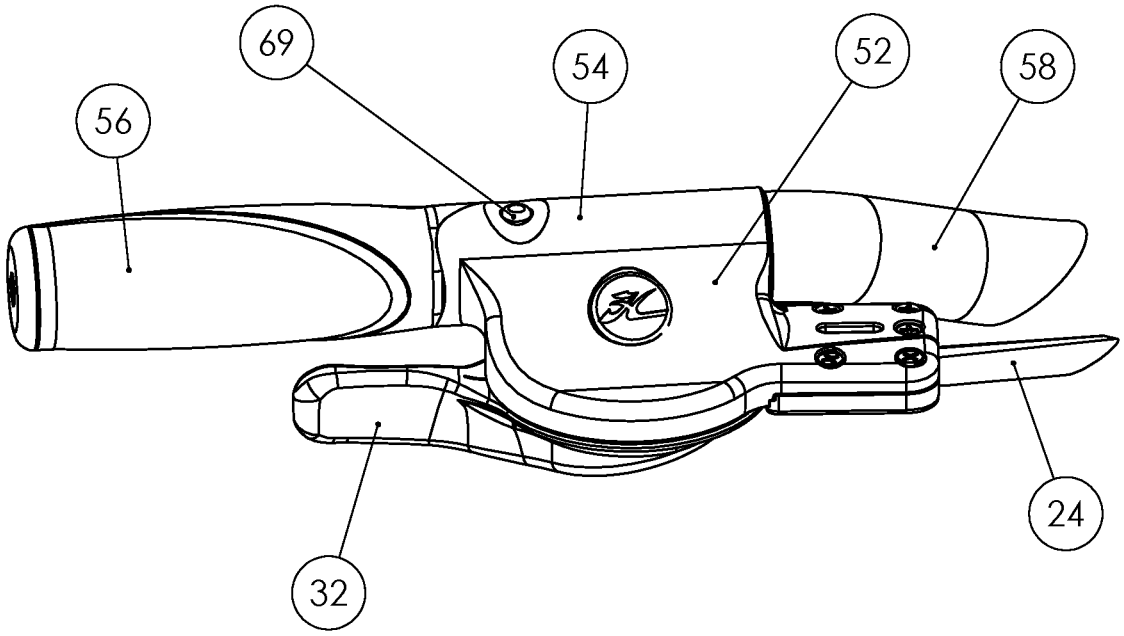
FIG. 11 is a plan view showing the steering handle with quick release elements for releasable attachment to the handle bars of the stand-up pedal board embodiment of this invention as shown in FIG. 8.
Figure 12A:
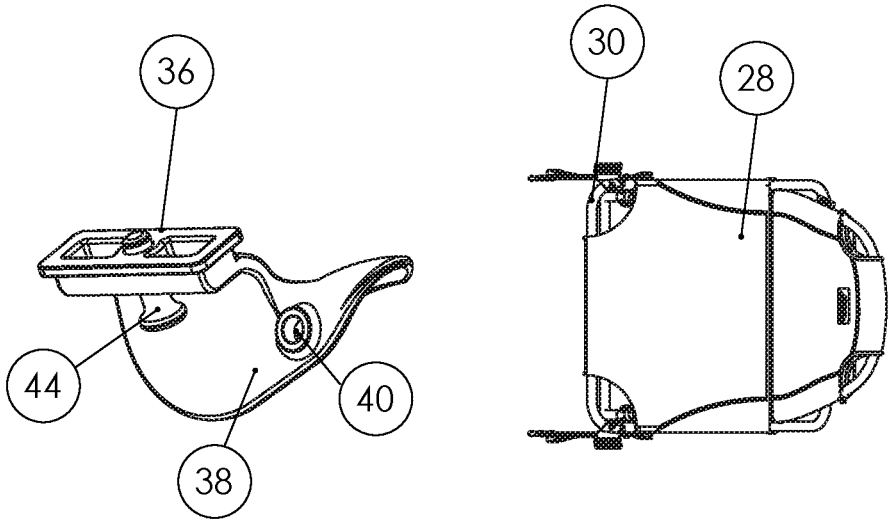
FIG. 12A is a top view of the chair shown in the pedaled sit on kayak watercraft of FIG. 7 together with the retainer for the steering handle and its housing before it is affixed to the tubing of the chair.
Figure 12B:
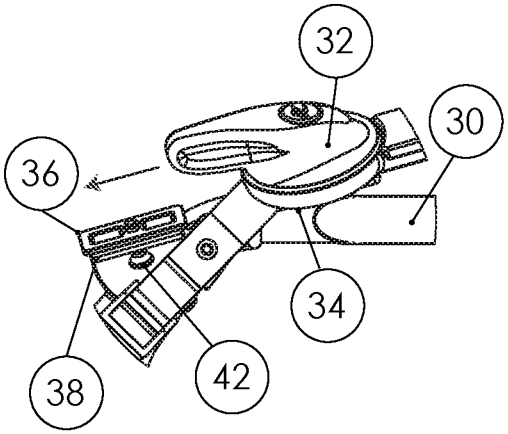
FIG. 12B is a partial perspective view showing the direction of movement to attach the steering handle and its housing to the retainer with the retainer affixed to the tubing of the chair.
Figure 12C:
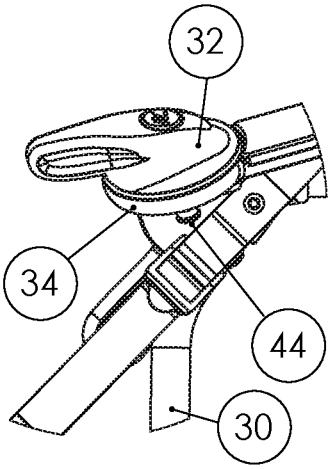
FIG. 12C shows the steering handle with housing releasably attached to the retainer when affixed to the tubing of the chair.
Figure 12D:
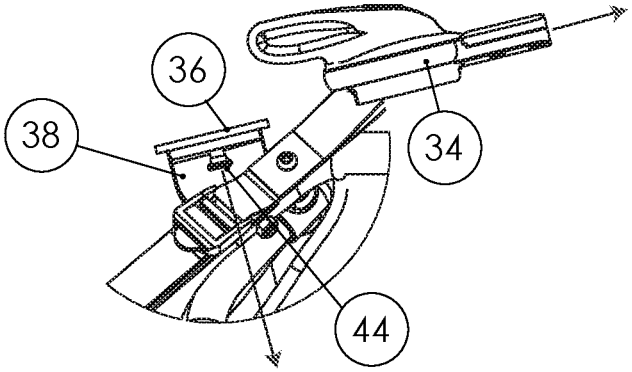
FIG. 12D shows the retainer with a slidable member received in a complementary slot formed in the bottom of the steering handle housing and release of the steering handle with housing from the retainer by pulling on the spring loaded quick release pin.
Figure 12E:
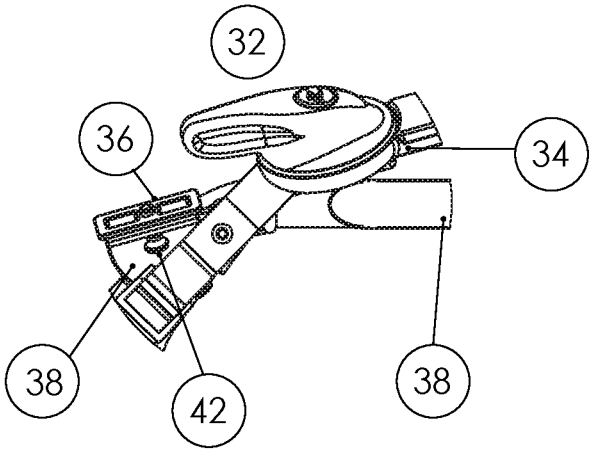
FIG. 12E shows the steering handle with housing released from the retainer by pulling the spring loaded release pin.

The stand-up embodiment is propelled by the operator stepping up and down on pedals 64 to operate flaps 48, FIG. 8.

The free-standing system of this invention can be quickly and readily released simply by pressing the quick release spring button 69 and pulling hollow tubular retainer 54 carrying housing 52 and steering handle 32 from the handlebar 60. In the case of the stand-up embodiment, the free end of the handlebar 60 serves as the retainer for the steering handle and its housing.

In both the sit down and stand up embodiments, the pedals and operator are positioned somewhat midway on the watercraft at the usual distance forward of the rudder.

Referring to the rudder 10 and its quick release, the rudder is carried at the rear end or transom 66 of the kayak, pedal board or other watercraft.

The rudder support 14 along with the rudder 10 is pivoted side to side to steer on vertical shaft 70 carried by rudder mount 12 by the operation of tensile cables 20 and 22 using the steering handle.

The rudder 10 can also be rotated about transverse shaft 72 in rudder support 14 by means of pull rope 74 to raise and lower. The pull rope 74 imparts a pivoting motion to rudder support 14 and rudder 10 about shaft 72. The weight of the rudder 10 carries it through either the stowed or deployed position. The bungee cord 76 keeps the blade in either position, while allowing the rudder to rotate somewhat freely to the rear when striking an obstacle in the water and avoiding rudder damage.

Figure 13:
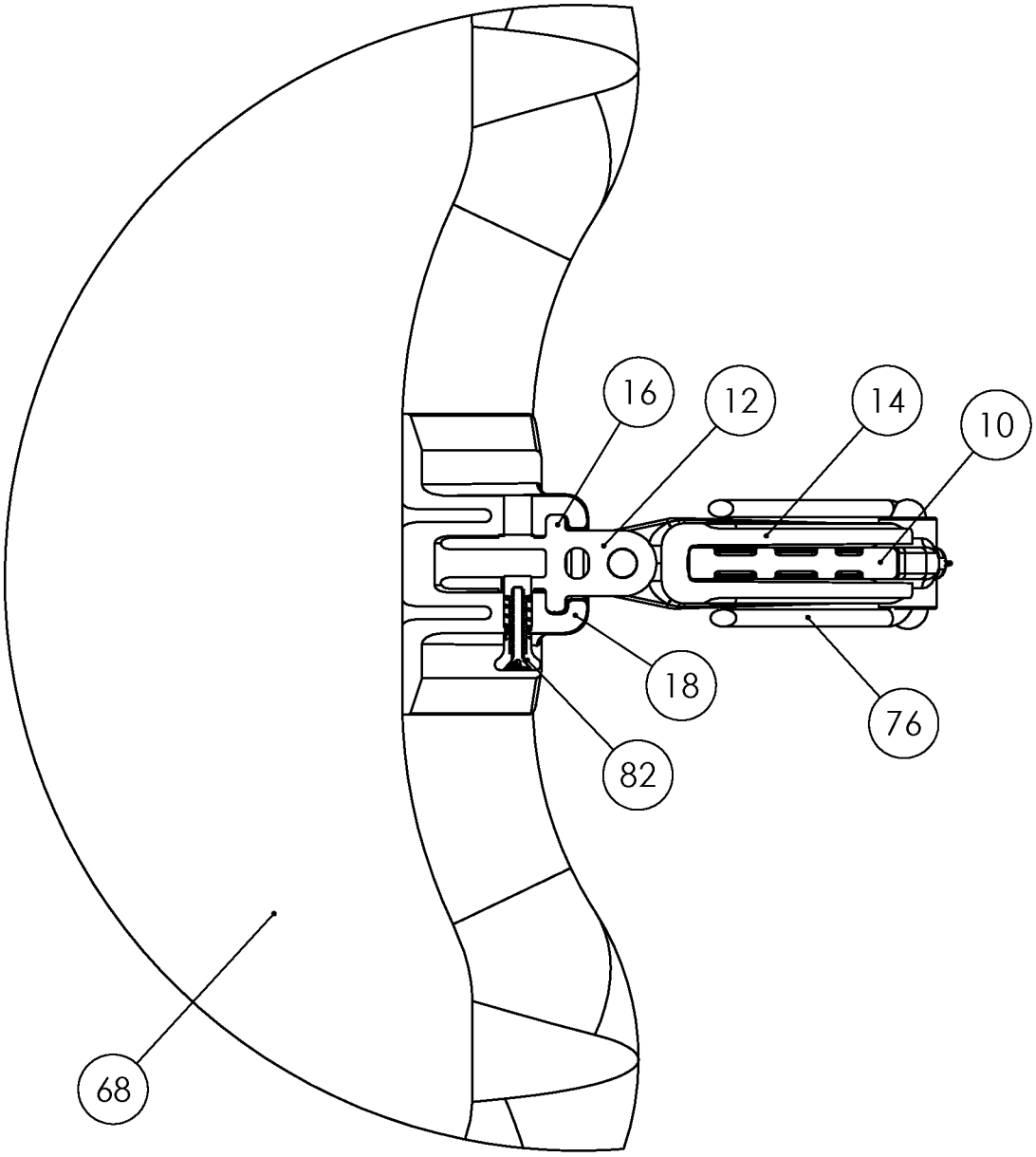
FIG. 13 is a partial top view with parts broken away to show the rudder mount connected to the retainer and the spring loaded quick release pin.
Figure 14:
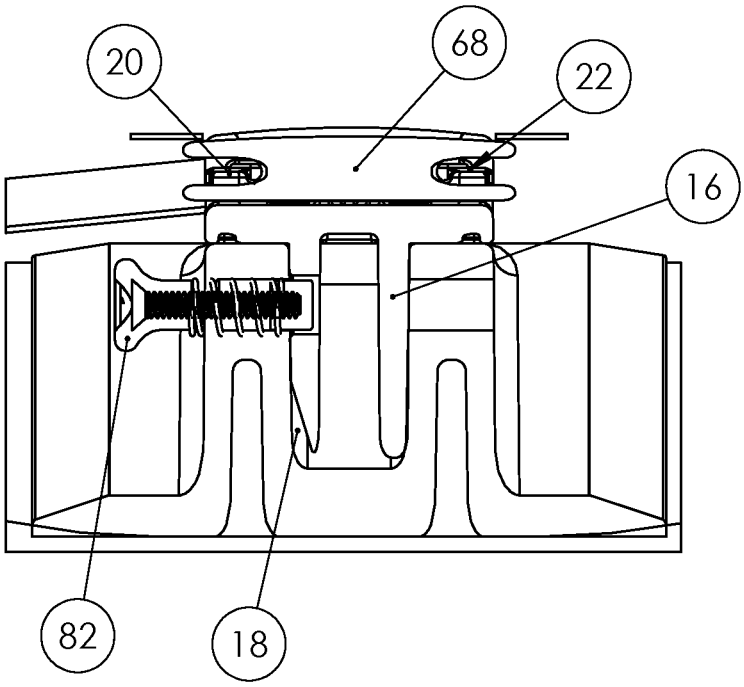
FIG. 14 is a view with parts broken away showing the quick release spring loaded release pin in place and extending into a hole in the retainer to secure the rudder mount to the retainer.
Figure 15:
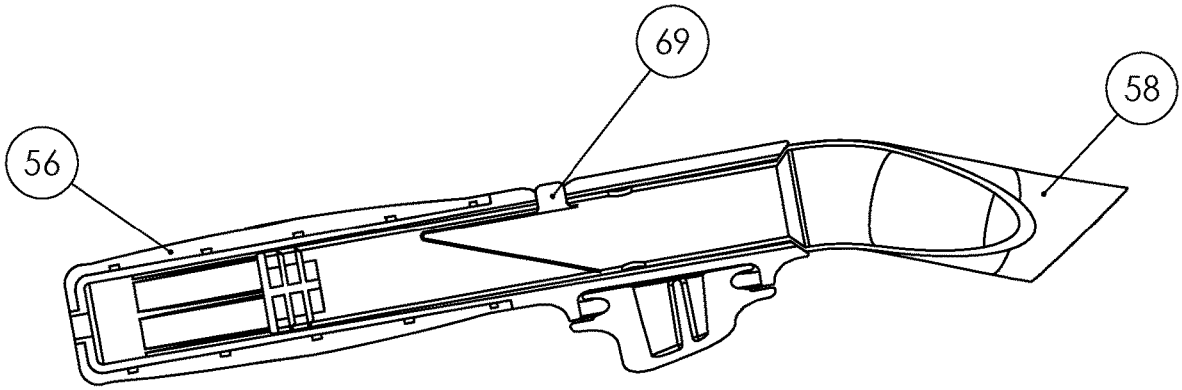
FIG. 15 is a sectional view of the handlebar grip showing the quick release spring button.

The quick release of the rudder is shown in FIGS. 9, 10A through 10D, 13 and 14. The retainer 18 is affixed to the rear of the watercraft. The retainer 18 has a hole 78. The rudder mount 12 also has a hole 80. When projection 16 on the rudder mount is received in the retainer 18, holes 78 and 80 align and a quick release pin 82 can be inserted. The release pin is spring loaded as shown in FIGS. 13 and 14. The entire rudder mechanism is easily and quickly released by operation of the quick release pin 82.

In use, the retainers 18 and 38 can be mechanically attached to the rear surface of the watercraft and the chair tubing, respectively. These elements need not be removeable as they do not interfere with the transport and storage of the watercraft. The handlebar and its upright and the chair can be removed from the watercraft and transported and stored separately.

The quick release elements projection 16, slidable member 36 and hollow tubular member 54 are elements of the quick release mechanism of the system of this invention and complement the retainers or handlebar to complete the quick release function.

What is claimed:

1. A watercraft comprising:

a deck;

a first retainer on a rear portion of the deck;

a rudder mechanism rotatably coupled to the first retainer, the rudder mechanism comprising:

a rudder support member, and a rudder pivotably mounted to the rudder support member, wherein the rudder is pivotable about a first axis relative to the rudder support member;

a shaft defining a second axis about which the rudder mechanism is rotatable relative to the first retainer;

a second retainer fixed to the watercraft;

a steering handle device releasably secured to the watercraft forward of the rudder mechanism, the steering handle device comprising:

a housing releasably secured to the second retainer, and a handle rotatably mounted to the housing; and a cable connecting the rudder mechanism to the steering handle device, wherein the handle of the steering handle device is operable to drive the cable to rotate the rudder mechanism about the second axis.

2. The watercraft of claim 1, wherein:

the cable is a first cable, and the watercraft comprises a second cable connecting the rudder mechanism to the steering handle device.

3. The watercraft of claim 2, wherein:

the rudder support member comprises a leftward portion and a rightward portion, the first cable is attached to the rightward portion of the rudder support member, and the second cable is attached to the leftward portion of the rudder support member.

4. The watercraft of claim 3, wherein:

the steering handle device is operable to drive the first cable to rotate the rudder mechanism about the second axis towards a first side of the watercraft and is operable to drive the second cable to rotate the rudder mechanism about the second axis towards a second side of the watercraft.

5. The watercraft of claim 3, wherein:

the shaft extends perpendicularly relative to a top planar surface of the deck and is positioned between the leftward portion and the rightward portion of the rudder support member.

6. The watercraft of claim 3, further comprising:

a rudder mounting member connected to the first retainer, the rudder mounting member carrying the shaft.

7. The watercraft of claim 1, wherein:

the rudder is pivotable about the first axis relative to the rudder support member from a deployed position to a stowed position.

8. The watercraft of claim 7, wherein:

the rudder is configured such that:

in the stowed position, the rudder extends forward from the rudder support member along an upper surface of the rear portion of the deck.

9. The watercraft of claim 8, wherein:

the rudder is configured such that:

in the deployed position, the rudder extends downward from the rudder support member.

10. The watercraft of claim 7, wherein:

the first axis is positioned above an upper surface of the rear portion of the deck, and extends parallel to a top surface of the deck.

11. The watercraft of claim 1, wherein:

the first axis extends perpendicular to a longitudinal axis of the watercraft, and the second axis extends perpendicular to the longitudinal axis of the watercraft and perpendicular to the first axis.

12. The watercraft of claim 1, wherein:

the rudder support member projects rearwardly and upwardly from the first retainer.

13. The watercraft of claim 1, wherein:

the handle projects radially outwardly from the housing of the steering handle device.

14. The watercraft of claim 1, wherein:

the cable is a first cable;

the watercraft comprises a second cable connecting the steering handle device to the rudder; and the steering handle device comprises:

a first slot between the housing and the handle along which the first cable is routed to attach to the handle, and a second slot between the housing and the handle along which the second cable is routed to attach to the handle.

15. The watercraft of claim 14, wherein:

the first slot and the second slot of the steering handle device are positioned at the same radial distance from a center of rotation of the handle.

16. The watercraft of claim 1, further comprising:

a retaining member releasably coupling the second retainer to the housing of the steering handle device, wherein the retaining member is movable relative to the second retainer and the housing of the steering handle device to separate the second retainer from the housing of the steering handle device.

17. The watercraft of claim 16, wherein:

the retaining member comprises a retaining pin, and the housing defines a hole within which the retaining pin is positioned.

18. The watercraft of claim 1, wherein:

the second retainer comprises a graspable handle.

19. The watercraft of claim 1, wherein:

the second retainer is configured to be grasped by a user.

20. The watercraft of claim 1, further comprising:

a releasable coupling mechanism for releasably securing the steering handle device to the watercraft, the releasable coupling mechanism comprising:

a slot, and a receiving member configured to be received by the slot to releasably secure the steering handle device to the watercraft.

21. The watercraft of claim 1, wherein the watercraft is a kayak.

22. The watercraft of claim 1, wherein the watercraft is pedal-driven.

23. A steering assembly for a watercraft, the steering assembly comprising:

a rudder mechanism configured to be rotatably coupled to the watercraft, the rudder mechanism comprising:

a rudder support member, and a rudder pivotably mounted to the rudder support member, wherein the rudder is pivotable about a first axis relative to the rudder support member;

a shaft on which the rudder mechanism is rotatably mounted, the shaft defining a second axis about which the rudder mechanism is rotatable relative to the watercraft;

a steering handle device releasably securable to the watercraft forward of the rudder mechanism, the steering handle device comprising:

a housing releasably securable to a retainer fixed to the watercraft, and a handle rotatably mounted to the housing; and a cable connecting the rudder mechanism to the steering handle device, wherein the handle of the steering handle device is operable to drive the cable to rotate the rudder mechanism about the second axis.

24. The steering assembly of claim 23, wherein:
the cable is a first cable,
the steering assembly comprises a second cable connecting the rudder mechanism to the steering handle device,
the rudder support member comprises a leftward portion and a rightward portion,
the first cable is attached to the rightward portion of the rudder support member, and
the second cable is attached to the leftward portion of the rudder support member.

25. The steering assembly of claim 24, wherein:
the handle is rotatable to drive the first cable and the second cable.

26. The steering assembly of claim 25, wherein:
the steering handle device comprises:
a first slot between the housing and the handle along which the first cable is routed to attach to the handle, and
a second slot between the housing and the handle along which the second cable is routed to attach to the handle.

27. The steering assembly of claim 26, wherein:
the first slot and the second slot of the steering handle device are equidistant from a center of rotation of the handle, and
the first cable and the second cable are attached to the rudder support member at locations equidistant from the shaft.

28. The steering assembly of claim 23, wherein:
the rudder is pivotable about the first axis relative to the rudder support member from a deployed position to a stowed position.

29. The watercraft of claim 20, wherein:
the receiving member is a slidable member configured to be received in the slot, wherein the slidable member is slidable relative to the slot to disengage the slidable member from the slot.

30. The watercraft of claim 1, wherein:
the cable comprises a portion extending from a rear portion of the housing of the steering handle device to the rudder mechanism, the portion of the cable being positioned above the deck.

31. The watercraft of claim 1, wherein:
the housing of the steering handle device is, when releasably secured to the second retainer, positioned above the deck.

32. The watercraft of claim 1, wherein:
the housing of the steering handle device is separable from the second retainer.

33. The watercraft of claim 1, wherein:
the second retainer is fixed to a chair of the watercraft.

34. A pedal-driven kayak comprising:
a deck;
a first retainer on a rear portion of the deck;
a pedal drive mechanism to propel the pedal-driven kayak, the pedal drive mechanism comprising:
flap members positionable below the deck, and
pedals positionable above the deck, the pedals operable to move the flap members;
a rudder mechanism rotatably coupled to the first retainer, the rudder mechanism comprising:
a rudder support member, and
a rudder pivotably mounted to the rudder support member, wherein the rudder is pivotable about a first axis relative to the rudder support member from a deployed position to a stowed position, wherein the rudder, in the deployed position, extends downward from the rudder support member, and wherein the rudder, in the stowed position, extends forward from the rudder support member along an upper surface of the rear portion of the deck;
a shaft defining a second axis about which the rudder mechanism is rotatable relative to the first retainer;
a second retainer fixed to the pedal-driven kayak;
a steering handle device releasably secured to the pedal-driven kayak forward of the rudder mechanism, the steering handle device comprising:
a housing releasably secured to the second retainer, and
a handle rotatably mounted to the housing;
a releasable coupling mechanism for releasably securing the steering handle device to the second retainer, the releasable coupling mechanism comprising a slot and a receiving member configured to be received by the slot to releasably secure the steering handle device to the second retainer;
a first cable connecting a rightward portion of the rudder support member to the steering handle device; and
a second cable connecting a leftward portion of the rudder support member to the steering handle device,
wherein the steering handle device is operable to drive the first cable to rotate the rudder mechanism about the second axis and is operable to drive the second cable to rotate the rudder mechanism about the second axis.

35. The pedal-driven kayak of claim 34, wherein:
the steering handle device is operable to drive the first cable to rotate the rudder mechanism about the second axis towards a first side of the pedal-driven kayak and is operable to drive the second cable to rotate the rudder mechanism about the second axis towards a second side of the pedal-driven kayak.

36. The pedal-driven kayak of claim 34, wherein:
the receiving member is a slidable member configured to be received in the slot to engage a lower portion of the housing of the steering handle device with a top of the second retainer;
the slidable member is slidable relative to the slot to disengage the slidable member from the slot; and
the housing of the steering handle device is positioned above the deck when the lower portion of the housing of the steering handle device is engaged with the top of the second retainer.

37. The pedal-driven kayak of claim 34, wherein:
the first cable comprises a portion extending from a rear portion of the housing of the steering handle device to the rudder mechanism, the portion of the first cable being positioned above the deck; and
the second cable comprises a portion extending from the rear portion of the housing of the steering handle device to the rudder mechanism, the portion of the second cable being positioned above the deck.

38. The pedal-driven kayak of claim 34, wherein the steering handle device comprises:
a first slot between the housing and the handle along which the first cable is routed to attach to the handle, and
a second slot between the housing and the handle along which the second cable is routed to attach to the handle,
wherein the first slot and the second slot of the steering handle device are positioned at the same radial distance from a center of rotation of the handle.

39. The pedal-driven kayak of claim 34, further comprising:
a retaining member releasably coupling the second retainer to the housing of the steering handle device, wherein the retaining member is movable relative to the second retainer and the housing of the steering handle device to separate the second retainer from the housing of the steering handle device.

40. The pedal-driven kayak of claim 34, wherein the deck comprises an opening for receiving the pedal drive mechanism.

41. A watercraft comprising:

a deck;

a retainer on a rear portion of the deck;

a rudder mechanism rotatably coupled to the retainer, the rudder mechanism comprising:

a rudder support member comprising a leftward portion and a rightward portion, and a rudder pivotably mounted to the rudder support member, wherein the rudder is pivotable about a first axis relative to the rudder support member;

a shaft defining a second axis about which the rudder mechanism is rotatable relative to the retainer;

a steering handle device releasably secured to the watercraft forward of the rudder mechanism; and first and second cables connecting the rudder mechanism to the steering handle device, the first cable being attached to the rightward portion of the rudder support member, and the second cable being attached to the leftward portion of the rudder support member, wherein the steering handle device is operable to drive the first cable or the second cable to rotate the rudder mechanism about the second axis.

42. The watercraft of claim 41, further comprising:

a releasable coupling mechanism for releasably securing the steering handle device to the watercraft, the releasable coupling mechanism comprising:

a slot, and a slidable member configured to be received by the slot, the slidable member being slidable relative to the slot to disengage the slidable member from the slot.

43. The watercraft of claim 41, wherein each of the first and second cables comprises a portion extending from the steering handle device to the rudder mechanism and being positioned above the deck.

44. The watercraft of claim 41, wherein:

the retainer is a first retainer;

the watercraft further comprises:

a second retainer positioned above the deck of the watercraft and forward of the rudder mechanism, wherein the second retainer comprises a hole configured to receive a fastening member for fixing the second retainer above the deck of the watercraft; and first and second tubes containing at least portions of the first and second cables, respectively, wherein each of the first and second tubes comprises a first end portion and a second end portion, extends between the first end portion and the second end portion, and is positioned above the deck;

the steering handle device comprises a housing and a handle rotatable relative to the housing, wherein the housing of the steering handle device comprises a lower portion for releasably engaging with an upper portion of the second retainer; and the first and second cables are engageable with the handle in a first portion of the housing and are routed from the first portion of the housing, through a second portion of the housing within which the first end portion of each of the first and second tubes is positioned, and then toward the rear portion of the deck, and the first retainer receives at least the second end portion of each of the first and second tubes.

45. A watercraft comprising:

a deck;

a retainer on a rear portion of the deck;

a rudder mechanism rotatably coupled to the retainer, the rudder mechanism comprising:

a rudder support member, and a rudder pivotably mounted to the rudder support member, wherein the rudder is pivotable about a first axis relative to the rudder support member from a deployed position to a stowed position, wherein the rudder is configured such that in the stowed position, the rudder extends forward from the rudder support member along an upper surface of the rear portion of the deck;

a shaft defining a second axis about which the rudder mechanism is rotatable relative to the retainer;

a steering handle device releasably secured to the watercraft forward of the rudder mechanism; and a cable connecting the rudder mechanism to the steering handle device, wherein the steering handle device is operable to drive the cable to rotate the rudder mechanism about the second axis.

46. The watercraft of claim 45, further comprising:

a releasable coupling mechanism for releasably securing the steering handle device to the watercraft, the releasable coupling mechanism comprising:

a slot, and a slidable member configured to be received by the slot, the slidable member being slidable relative to the slot to disengage the slidable member from the slot.

47. The watercraft of claim 45, wherein the cable comprises a portion extending from the steering handle device to the rudder mechanism and being positioned above the deck.

48. The watercraft of claim 45, wherein:

the retainer is a first retainer;

the cable is a first cable;

the watercraft further comprises:

a second cable connecting the rudder mechanism to the steering handle device, a second retainer positioned above the deck of the watercraft and forward of the rudder mechanism, wherein the second retainer comprises a hole configured to receive a fastening member for fixing the second retainer above the deck of the watercraft; and first and second tubes containing at least portions of the first and second cables, respectively, wherein each of the first and second tubes comprises a first end portion and a second end portion, extends between the first end portion and the second end portion, and is positioned above the deck;

the steering handle device comprises a housing and a handle rotatable relative to the housing, wherein the housing of the steering handle device comprises a lower portion for releasably engaging with an upper portion of the second retainer; and the first and second cables are engageable with the handle in a first portion of the housing and are routed from the first portion of the housing, through a second portion of the housing within which the first end portion of each of the first and second tubes is positioned, and then toward the rear portion of the deck, and the first retainer receives at least the second end portion of each of the first and second tubes.

49. A watercraft comprising:
a deck;
a retainer on a rear portion of the deck;
a rudder mechanism rotatably coupled to the retainer, the rudder mechanism comprising:
a rudder support member, and
a rudder pivotably mounted to the rudder support member, wherein the rudder is pivotable about a first axis relative to the rudder support member;
a shaft defining a second axis about which the rudder mechanism is rotatable relative to the retainer;
a steering handle device releasably secured to the watercraft forward of the rudder mechanism, the steering handle device comprises:
a housing; and
a handle rotatably mounted to the housing; and
first and second cables connecting the rudder mechanism to the steering handle device, the first cable being routed along a first slot between the housing of the steering handle device and the handle to attach to the handle, and the second cable being routed along a second slot between the housing of the steering handle device and the handle to attach to the handle, wherein the handle of the steering handle device is rotatable to drive the first cable to rotate the rudder mechanism about the second axis and is rotatable to drive the second cable to rotate the rudder mechanism about the second axis.

50. The watercraft of claim 49, further comprising:
a releasable coupling mechanism for releasably securing the steering handle device to the watercraft, the releasable coupling mechanism comprising:
a slot, and
a slidable member configured to be received by the slot, the slidable member being slidable relative to the slot to disengage the slidable member from the slot.

51. The watercraft of claim 49, wherein each of the first and second cables comprises a portion extending from the steering handle device to the rudder mechanism and being positioned above the deck.

52. The watercraft of claim 49, wherein:
the retainer is a first retainer;
the watercraft further comprises:
a second retainer positioned above the deck of the watercraft and forward of the rudder mechanism, wherein the second retainer comprises a hole configured to receive a fastening member for fixing the second retainer above the deck of the watercraft; and
first and second tubes containing at least portions of the first and second cables, respectively, wherein each of the first and second tubes comprises a first end portion and a second end portion, extends between the first end portion and the second end portion, and is positioned above the deck;
the housing of the steering handle device comprises a lower portion for releasably engaging with an upper portion of the second retainer; and
the first and second cables are engageable with the handle in a first portion of the housing and are routed from the first portion of the housing, through a second portion of the housing within which the first end portion of each of the first and second tubes is positioned, and then toward the rear portion of the deck, and the first retainer receives at least the second end portion of each of the first and second tubes.

53. A kayak comprising:
a deck;
a first retainer on a rear portion of the deck;
a rudder mechanism rotatably coupled to the first retainer, the rudder mechanism comprising:
a rudder support member, and
a rudder pivotably mounted to the rudder support member, wherein the rudder is pivotable about a first axis relative to the rudder support member;
a shaft defining a second axis about which the rudder mechanism is rotatable relative to the first retainer;
a second retainer positioned above the deck of the kayak and forward of the rudder mechanism, wherein the second retainer comprises a hole configured to receive a fastening member for fixing the second retainer above the deck of the kayak;
a steering handle device releasably secured to the kayak forward of the rudder mechanism, the steering handle device comprising a housing and a handle rotatable relative to the housing, wherein the housing of the steering handle device comprises a lower portion for releasably engaging with an upper portion of the second retainer;
a first cable connecting the rudder mechanism to the steering handle device, wherein the steering handle device is operable to drive the first cable to rotate the rudder mechanism about the second axis;
a second cable connecting the rudder mechanism to the steering handle device; and
first and second tubes containing at least portions of the first and second cables, respectively, wherein each of the first and second tubes comprises a first end portion and a second end portion, extends between the first end portion and the second end portion, and is positioned above the deck,
wherein the first and second cables are engageable with the handle in a first portion of the housing and are routed from the first portion of the housing, through a second portion of the housing within which the first end portion of each of the first and second tubes is positioned, and then toward the rear portion of the deck, and the first retainer receives at least the second end portion of each of the first and second tubes.

54. The kayak of claim 53, further comprising:
a releasable coupling mechanism for releasably securing the steering handle device to the kayak, the releasable coupling mechanism comprising:
a slot, and
a slidable member configured to be received by the slot, the slidable member being slidable relative to the slot to disengage the slidable member from the slot.

55. The kayak of claim 53, wherein the first cable comprises a portion extending from the steering handle device to the rudder mechanism and being positioned above the deck.

56. A watercraft comprising:
a deck;
a first retainer on a rear portion of the deck;
a rudder mechanism rotatably coupled to the first retainer, the rudder mechanism comprising:
a rudder support member, and
a rudder pivotably mounted to the rudder support member, wherein the rudder is pivotable about a first axis relative to the rudder support member;
a shaft defining a second axis about which the rudder mechanism is rotatable relative to the first retainer;
a second retainer positioned above the deck of the watercraft and forward of the rudder mechanism, wherein the second retainer comprises a hole configured to receive a fastening member for fixing the second retainer above the deck of the watercraft;

a steering handle device releasably secured to the watercraft forward of the rudder mechanism, the steering handle device comprising a housing and a handle rotatable relative to the housing, wherein the housing of the steering handle device comprises a lower portion for releasably engaging with an upper portion of the second retainer; and a first cable connecting the rudder mechanism to the steering handle device, wherein the steering handle device is operable to drive the first cable to rotate the rudder mechanism about the second axis;

a second cable connecting the rudder mechanism to the steering handle device; and first and second tubes containing at least portions of the first and second cables, respectively, wherein each of the first and second tubes comprises a first end portion and a second end portion, extends between the first end portion and the second end portion, and is positioned above the deck, wherein the first and second cables are engageable with the handle in a first portion of the housing and are routed from the first portion of the housing, through a second portion of the housing within which the first end portion of each of the first and second tubes is positioned, and then toward the rear portion of the deck, and the first retainer receives at least the second end portion of each of the first and second tubes, and wherein the watercraft is pedal-driven.

57. The watercraft of claim 56, further comprising:

a releasable coupling mechanism for releasably securing the steering handle device to the watercraft, the releasable coupling mechanism comprising:

a slot, and a slidable member configured to be received by the slot, the slidable member being slidable relative to the slot to disengage the slidable member from the slot.

58. The watercraft of claim 56, wherein the first cable comprises a portion extending from the steering handle device to the rudder mechanism and being positioned above the deck.

59. A steering assembly for a watercraft, the steering assembly comprising:

a rudder mechanism configured to be rotatably coupled to the watercraft, the rudder mechanism comprising:

a rudder support member comprising a leftward portion and a rightward portion, and a rudder pivotably mounted to the rudder support member, wherein the rudder is pivotable about a first axis relative to the rudder support member;

a shaft on which the rudder mechanism is rotatably mounted, the shaft defining a second axis about which the rudder mechanism is rotatable relative to the watercraft;

a steering handle device releasably securable to the watercraft forward of the rudder mechanism; and first and second cables connecting the rudder mechanism to the steering handle device, the first cable being attached to the rightward portion of the rudder support member, and the second cable being attached to the leftward portion of the rudder support member wherein the steering handle device is operable to drive the first cable to rotate the rudder mechanism about the second axis and is operable to drive the second cable to rotate the rudder mechanism about the second axis.

60. The steering assembly of claim 59, wherein:

the steering handle device comprises:

a housing; and a handle rotatably mounted to the housing, the handle rotatable to drive the first cable and the second cable.

61. The steering assembly of claim 59, wherein each of the first and second cables comprises a portion extending from the steering handle device to the rudder mechanism and being positionable above a deck of the watercraft.

62. The steering assembly of claim 59, wherein:

first and second tubes containing at least portions of the first and second cables, respectively, wherein each of the first and second tubes comprises a first end portion and a second end portion, extends between the first end portion and the second end portion, and is positionable above a deck of the watercraft, the first end portion of each of the first and second tubes received by the steering handle device, and the second end portion of each of the first and second tubes configured to be received by a retainer of the watercraft;

the steering handle device comprises a housing and a handle rotatable relative to the housing, wherein the housing of the steering handle device comprises a lower portion for releasably engaging with the watercraft; and the first and second cables are engageable with the handle in a first portion of the housing and are routed from the first portion of the housing, through a second portion of the housing within which the first end portion of each of the first and second tubes is positioned, and then toward the rudder mechanism.

* * * * *